United States Patent [19]

Ciordinik et al.

[11] Patent Number: 4,676,485

[45] Date of Patent: Jun. 30, 1987

[54] INTRUSION WARNING WIRE FENCE

[75] Inventors: Jacques Ciordinik; Federico Ciordinik, both of Bologna; Alessandro Penzo, Crespellano, all of Italy

[73] Assignee: CI.KA.RA. S.p.A., Bolonga, Italy

[21] Appl. No.: 843,737

[22] Filed: Mar. 25, 1986

[30] Foreign Application Priority Data

Mar. 27, 1985 [IT] Italy ..... 12464 A/85

[51] Int. Cl.[4] ..... E04H 17/00

[52] U.S. Cl. ..... 256/12; 256/10; 340/550

[58] Field of Search ..... 256/10, 11, 12; 340/550, 564

[56] References Cited

U.S. PATENT DOCUMENTS

| | | | |
|---|---|---|---|
| 3,771,767 | 11/1973 | Dougherty | 256/12 X |
| 4,318,088 | 3/1982 | Hunter | 256/10 X |
| 4,525,701 | 6/1985 | Leih | 256/10 X |
| 4,558,308 | 12/1985 | Ciordinik et al. | 340/550 |

FOREIGN PATENT DOCUMENTS

| | | | |
|---|---|---|---|
| 3304186 | 9/1984 | Fed. Rep. of Germany | 256/10 |
| 1278646 | 6/1972 | United Kingdom | 256/10 |

*Primary Examiner*—Andrew V. Kundrat
*Attorney, Agent, or Firm*—King & Schickli

[57] ABSTRACT

This invention relates to an intrusion warning wire fence secured to spaced supporting poles. The fence comprises one or more electrical and/or optical conductors, preferably optical fibers, which may be either (1) incorporated within one or more tubular wires of said wire fence and/or (2) associated exteriorly with one or more wires of said fence, and/or (3) arranged freely in the fence, and which are connected to an intrusion warning system capable of emitting a warning and/or alarm signal in case of breakage or reduction of the conduction capability of at least one of said conductors. According to the invention, in order to prevent anyone from stepping over or scaling the fence, the fence is extended upwards beyond the upper ends of the supporting poles. This and this upper unsupported portion of the fence will be either distorted (bent, flexed) and/or broken, at least locally, if anyone tries to scale the fence. Extending in the upper unsupported portion of the fence and/or between this upper unsupported portion of the fence and the supporting poles, and/or between said upper unsupported portion and the underlying portion of the fence which is stretched between the supporting poles, is at least one electrical and/or optical conductor which will be either broken or distorted (bent, stretched, crushed) as a result of any breakage or distortion of the upper unsupported portion of the fence, so as to provide a warning or alarm signal.

14 Claims, 2 Drawing Figures

INTRUSION WARNING WIRE FENCE

SUMMARY OF THE INVENTION

This invention relates to an intrusion warning wire fence secured to spaced supporting poles and comprising one or more electrical and/or optical conductors, preferably optical fibres, which may be either incorporated within one or more tubular wires of said wire fence. Alternatively, the conductors may be associated exteriorly with one or more wires of said fence, and/or arranged freely in the fence. These conductors are connected to an intrusion warning system capable of emitting a warning and/or alarm signal in case of breakage or reduction of the conduction capability of at least one of said conductors.

This invention aims to further increase the level of protection and reliability of said intrusion warning wire fence and, more particularly, it aims to provide a response of the warning systems, i.e. to cause the emission of a warning and/or alarm signal, even if anyone just tries to step over said wire fence.

This object is achieved by the invention, substantially by virtue of the fact that said fence extends upwards beyond the upper end of the supporting poles. This upper unsupported portion of the fence will be either distorted (bent, flexed) and/or broken, at least locally, if anyone tries to step over the fence. At least one electrical or optical conductor is provided in: said upper unsupported portion of the fence and/or between said upper unsupported portion and the supporting poles; and/or between said upper unsupported portion of the fence and the underlying portion of the fence which is stretched between the supporting poles. This electrical or optical conductor will be either broken or distorted (bent, stretched, crushed) as a result of any breakage or distortion of the upper unsupported portion of the wire fence that occurs whenever anyone attempts to step over or scale the fence. As a result a warning or alarm signal is provided.

This invention may be embodied in several ways, depending upon the construction of the intrusion warning wire fence.

Preferably, according to a further characteristic of the invention and in order to further increase the reliability thereof against any attempt of trespassing, the wire fence comprises localized or continuous interruptions and/or mechanical weakenings in the upper unsupported portion which extends beyond the upper ends of the supporting poles and/or between said upper unsupported portion and the underlying portion of the wire fence which is stretched between the supporting poles. These interruptions or weakenings facilitate the breakage or the distortion of said upper unsupported portion of the fence with respect to the underlying portion of the fence, in case of any attempt to step over said fence.

BRIEF DESCRIPTION OF THE DRAWINGS

A preferred embodiment of the invention is shown as a non-limitating example in the accompanying drawings, wherein.

DESCRIPTION OF THE PREFERRED EMBODIMENT

With reference to the Figures, the wire fence illustrated therein comprises fence panels 1 arranged between supporting poles 2 and secured to said poles 2 by means known in the art. The panels 1 of the fence comprise, for example, wires 3, termed here "sensitive wires" in that they are associated with electrical or optical conductors connected to a warning systems, and wires 4, termed here "normal wires" in that they are not provided with electrical or optical conductors and have a predominantly mechanical protection. The sensitive wires 3, shown with solid lines in FIG. 1, may be constituted by tubular wires containing therein loosely, i.e. with sufficient clearance, one or more electrical and/or optical conductors. An example of such a "sensitive wire" construction is shown in the previously issued U.S. Pat. No. 4,558,308 to Ciordinik, et al. The normal wires 4 may be of any suitable type. Preferably, but not necessarily, the tubular sensitive wires 3 have the same external appearance as the other wires 4, whereby the wires 3 and 4 cannot be visually distinguished from one another.

Figure 1:
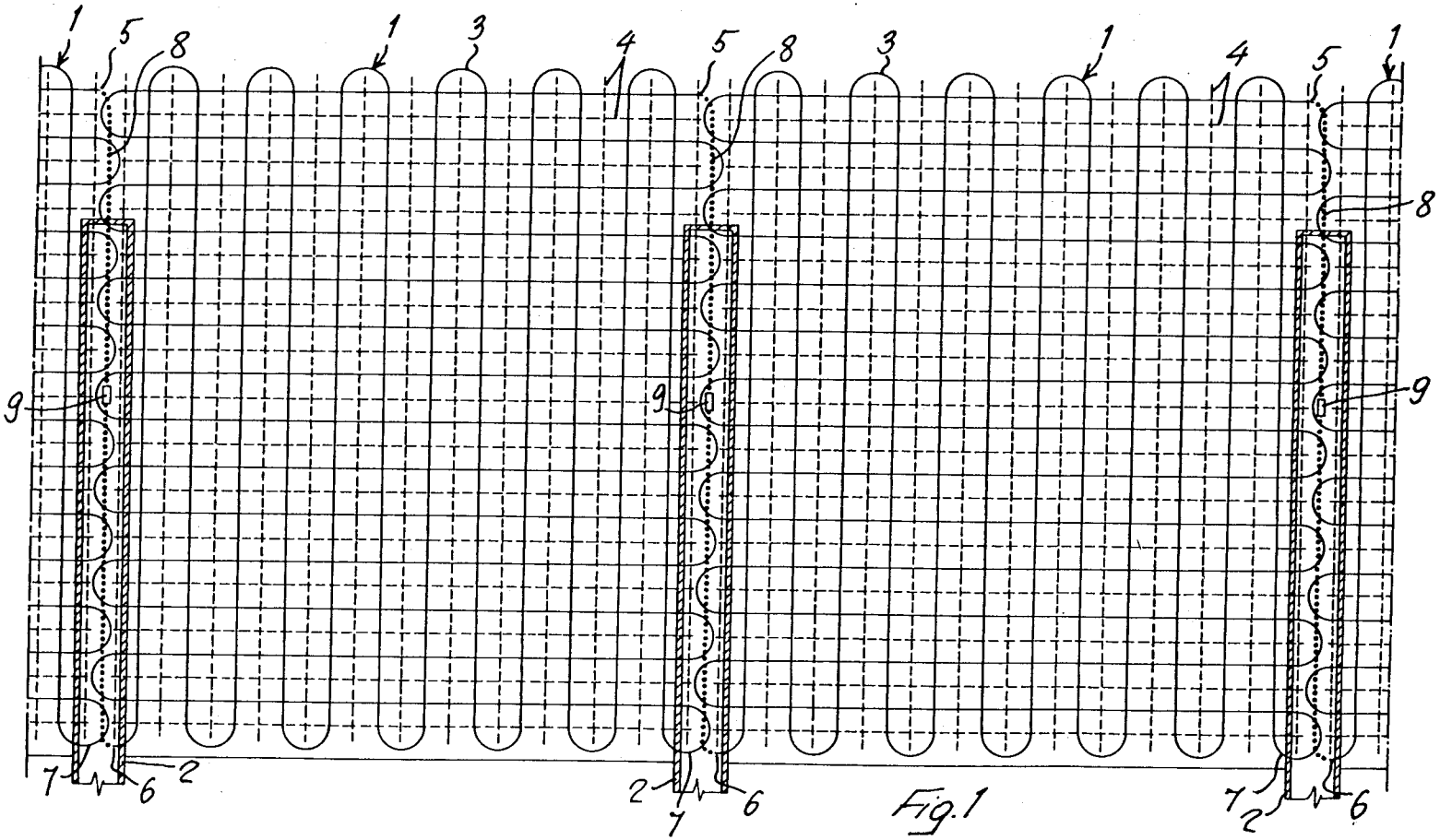
FIG. 1 is a diagrammatic elevational view of an intrusion warning wire fence according to the invention.

In the illustrated exemplary embodiment, each panel 1 of the wire fence is constituted by two looped-over wire assemblies each formed by a continuous tubular sensitive wire 3 and placed over each other in a 90° rotated condition to each other. These two looped wire assemblies are secured to each other at a corner 7 of the respective panel 1 of the wire fence, so as to form a grid made of two looped wire assemblies constituted by a continuous tubular wire containing one or more electrical and/or optical conductors and having an open end 5 at an upper corner of the panel 1 and an open end 6 at the lower diametrically opposite corner of said panel 1. The normal wires 4, shown with broken lines in FIG. 1, are directed both vertically (parallel to the supporting poles 2) and horizontally (perpendicular to the supporting poles) and are superposed and secured (e.g. welded) to the double grid of looped sensitive wires 3.

Instead of forming a grid made of two looped wire assemblies as described above, the tubular sensitive wires 3 may form, in each panel 1 of the fence, a single looped wire assembly having parallel wire lengths, arranged either vertically or horizontally, and comprising again an open end 5 at an upper corner and an open end 6 at the diametrically opposed lower corner.

The sensitive wires of each panel 1 of the wire 3 fence, instead of comprising tubular wires, may be formed with a longitudinal groove accomodating one or more electrical and/or optical conductors. The sensitive wires 3 may even be formed by plain ordinary wires having one or more electrical and/or optical conductors affixed in any suitable manner (e.g. glued) on the outer surface thereof.

Each panel 1 of the wire fence may be constituted by sensitive wires 3 and normal wires 4, or it may be constituted only by sensitive wires, i.e. wires which are all associated with one or more electrical or optical conductors.

The panels 1 of the wire fence may be secured to the supporting poles 2 in any suitable manner. Preferably, however, the wire fence comprises box-type supporting poles 2 and the panels 1 of the wire fence are secured to these poles in the manner described in other patents of the same owner (see, for example, U.S. Pat. No. 4,558,308). More particularly, each box-type pole 2 may be formed by an upright having a U shape in cross section the open side of which is directed preferably towards the area enclosed by the fence and may be closed by an optional side door. The edges of the two side walls of the upright, at the open side thereof, are provided with notches which are spaced from each other a distance corresponding to the space between the horizontally extending portions of the tubular wires 3 and non-tubular wires 4 of the two panels 1 associated to a box-type pole 2. The horizontal stretches of the wires 3, 4 of these two panels 1 of the fence will be inserted into said notches, so that the last vertical wire 4 of each panel 1 of the fence and/or the end elbows which join the horizontal tubular wires 3 will be accomodated within the interior of the box-type pole 2 into which they will be introduced through the open side of the U-shaped upright. The panels 1 of the wire fence will be then secured to the supporting box-type pole 2 by means of the respective side door which is secured to said pole by any suitable means, preferably so as to be removable therefrom, thus closing the open side of the pole and the respective notches. Each pole is closed at the top thereof by any suitable means (not shown in the drawings).

The electrical and/or optical conductors associated with the sensitive wires 3 are connected to a warning system capable of emitting a warning or alarm signal when one of said electrical or optical conductors is either broken or distorted, e.g. stretched, so as to reduce the conduction capability thereof, particularly in case of optical conductors (optical fibres).

Figure 2:
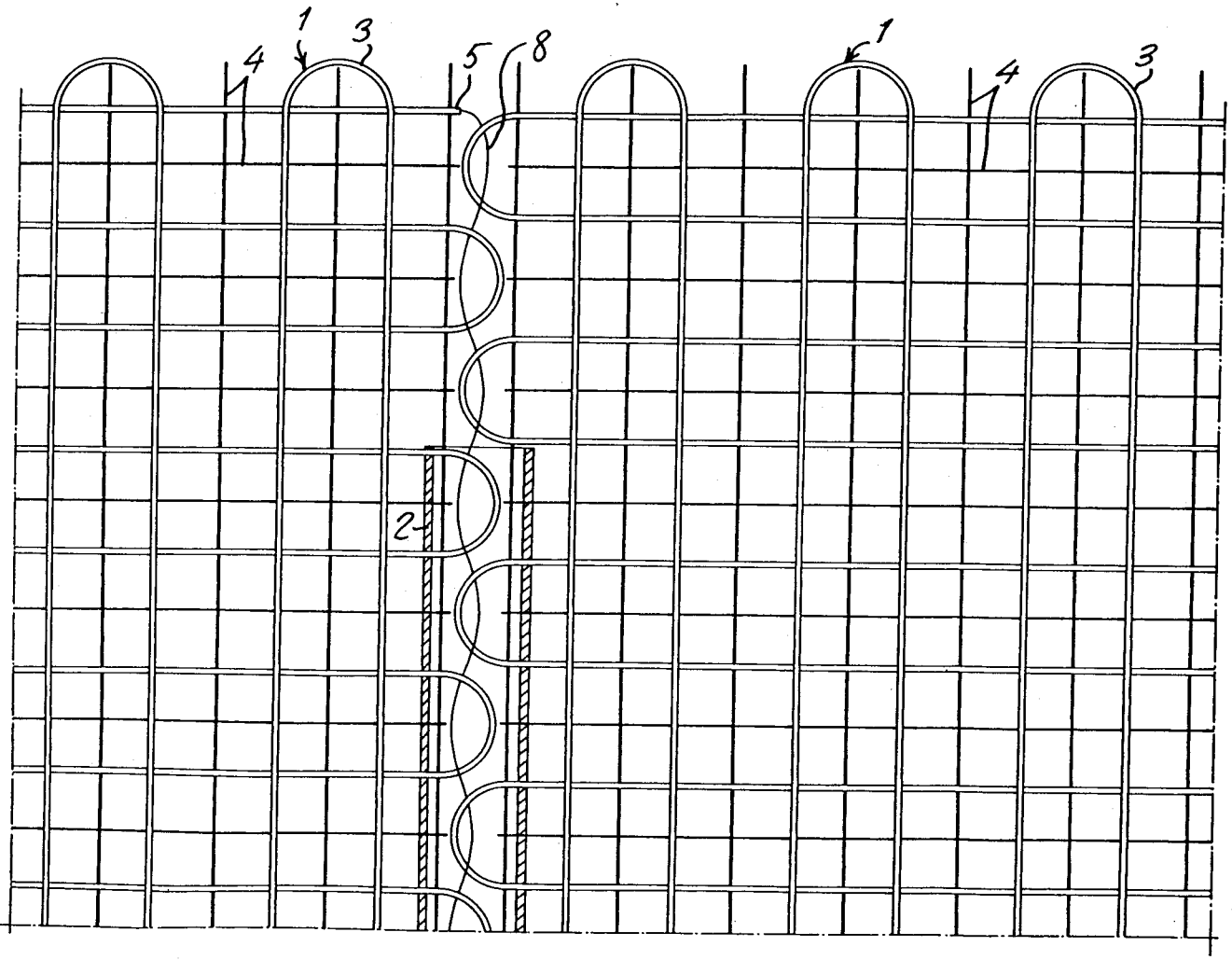
FIG. 2 is a diagrammatic elevational view, on a larger scale, the portion of the wire fence on a supporting pole.

According to the invention, in order to obtain a warning or alarm signal even in case of an attempt to step over the fence, the panels 1 of the fence have such a height as to extend upwards a certain length beyond the top ends of the supporting poles 2. These upper portions of the panels 1 are not joined mechanically to each other, i.e. they extend unsupported upwards beyond the top ends of the associated poles 2 and have no support. The electrical and/or optical conductor(s) 8 contained within the tubular wires 3 of the grid of two looped wire assemblies of each panel 1 of the fence, project out of the open top end 5 of one of the panels 1 of the wire fence associated with one supporting pole 2, and out of the open bottom end 6 of the other panel 1 of the wire fence associated with the same supporting pole 2, and are connected to each other by means of a junction 9 within the box-type pole 2. This electrical and/or optical conductor (or conductors) 8, shown with dotted lines in FIG. 1, therefore, extends from the bottom end 6 of one of the panels 1 of the fence, through the interior of the pole 2, through the top cover thereof, and then it projects out therefrom up to the top end 5 of the other panel 1 of the wire fence. This upper external portion of the electrical and/or optical conductor (or conductors) is engaged with the corresponding upper unsupported portions of both panels 1 of the fence which are associated with the supporting pole 2, for example, it may be secured by any means to said upper unsupported portions of both panels 1 of the fence. In the illustr(ated embodiment, said upper external portion of the electrical and/or optical conductor (or conductors) 8 is passed alternately through the end loops of the looped wires 3 comprised in the panels 1 of the wire fence, as shown more particularly in FIG. 2.

In these conditions, when a person tries to step over or scale the fence by climbing thereon, the weight of said person causes a displacement of the upper unsupported portion of a panel 1 of the wire fence, either outwards or inwards with respect to the upper unsupported portion of at least one of the adjacent panels 1 of the wire fence. More particularly, the weighted said upper unsupported portion of the panel 1 of the fence bends or deflects while the upper unsupported portions of the adjacent panel 1 of the fence remain in their normal position, since they are not connected mechanically to the bent or deflected upper portion of the panel 1 of the wire fence. This relative displacement between the two upper unsupported portions of two adjacent panels 1 of the wire fence causes a breakage or a distortion (stretching, bending) of the respective upper external stretch of the electrical and/or optical conductor(s) 8 interconnecting said pair of upper portions, such as to cause the emission of a warning or alarm signal from the warning system.

The electrical and/or optical conductor(s) 8, at the passage through the top lid of the supporting poles 2, preferably, is (are) suitably fixed or locked to the lid of said pole. Therefore, when an intruder tries to step over the fence at a supporting pole 2, should he cause (which is very unlikely) a simultaneous and equally-directed displacement (bending, flexing, or the like) with no relative displacement of the adjacent upper unsupported portions of the two panels 1 associated with the same pole 2, the upper external stretch of the electrical and/or optical conductor(s) 8 will be broken or distorted (bent, crushed) at the point where it is fixed to the lid of the supporting pole 2, thus providing the warning or alarm signal.

Of course, the invention is not limited to the embodiments described and shown herein, but broad changes and modifications may be made thereto and it may be applied to any type of intrusion warning wire fences. More particularly, the two panels 1 of the wire fence associated with the same supporting pole 2 need not be mechanically disconnected from each other in their upper portion protruding upwards beyond the top end of the pole 2, as in the illustrated embodiment. In fact, the two panels 1 of the fence that are associated with a supporting pole 2 may be mechanically connected to each other in their upper portion extending upwards beyond the top end of the pole 2, provided that said mechanical connection is so weak and/or is of such a construction as to allow said relative displacement between the two panels 1 of the wire fence when said fence is scaled. In this way attempts to scale the fence still cause the breakage and/or distortion of the upper unsupported stretch of the electrical and/or optical conductor or conductors, as described above.

The invention may also be applied to intrusion warning wire fences that, rather than comprising individual panels 1 connected to each other at the supporting poles 2, comprise—at least for a certain length—a continuous stretch of a wire fence of any construction, for example of the mesh type. The wires of such a fence are constructed thoroughly or at least partly as sensitive wires (i.e. they are all or at least in part associated with electrical and/or optical conductors) and the wire fence is secured in any suitable manner to any desired type of supporting poles. In this instance, according to the invention, the wire fence is extended upwards, unsupported beyond the top ends of the poles, to such an extent whereby an intruder attempting to step over the fence will cause at least a distortion (bending, flexing) of said upper unsupported portion of the fence with respect to the lower portion thereof which is stretched between the supporting poles. In this circumstance, at least one electrical or optical conductor of the fence extends along such a path between the lower fixed portion of the wire fence and said upper unsupported portion thereof, whereby said conductor will be broken or distorted so as to provide a warning or alarm signal when the upper unsupported portion of the fence is distorted (bent, flexed) with respect to the lower portion of the wire fence.

According to a further characteristic of the invention, between the upper portion of the wire fence, which extends upwards unsupported beyond the top ends of the supporting poles, and the underlying portion of the wire fence, which is stretched between the supporting poles, there may be provided in the wire fence any mechanical weakening such as to facilitate the distortion and the displacement of said upper portion of the fence with respect to said underlying portion of said fence, or such as to cause even a rupture, at least locally, of said upper unsupported portion of the wire fence upon an attempt of stepping thereover, with resulting rupture or distortion (bending, crushing, or the like) of at least one electrical or optical conductor.

We claim:

1. An intrusion warning wire fence, comprising:

two spaced supports;

a wire fence panel including lower and upper portions, said lower portion being stretched between and connected to said supports so as to be supported thereby, said upper portion extending above top ends of said supports so as to be substantially unsupported thereby;

an energy conductor incorporated into said fence panel; and intrusion warning system means for emitting a warning signal in response to a breakage or reduction of the conduction capability of said energy conductor;

said upper unsupported portion of said fence being at least locally distorted or broken by anyone attempting to scale said fence and said energy conductor being arranged so as to distort or break as a result of any distortion or breakage of said upper portion thereby causing the emission of a warning signal.

2. The intrusion warning wire fence of claim 1, wherein said energy conductor is provided in said upper portion of said fence panel.

3. The intrusion warning wire fence of claim 1, wherein said energy conductor is provided between said unsupported upper portion of said fence panel and said supports.

4. The intrusion warning wire fence of claim 1, wherein said energy conductor is provided between said upper portion of said fence panel and said underlying lower portion of said fence panel.

5. The intrusion warning wire fence of claim 1, wherein said energy conductor is exteriorly attached to at least one wire of said fence.

6. The intrusion warning wire fence of claim 1, wherein said panel includes at least one tubular wire, said energy conductor being received within said tubular wire.

7. The intrusion warning wire fence of claim 1, wherein said energy conductor is extended freely across said fence panel.

8. The intrusion warning wire fence of claim 1, wherein said fence panel is mechanically weakened in said upper unsupported portion of said fence so as to facilitate distortion or breakage of said upper unsupported portion with respect to said underlying lower portion in response to any attempt by an individual to scale said fence.

9. The intrusion warning wire fence of claim 1, wherein said fence panel is mechanically weakened between said upper and lower portions so as to facilitate distortion or breakage of said upper unsupported portion with respect to said underlying lower portion in response to any attempt by an individual to scale said fence.

10. The intrusion warning wire fence of claim 1, wherein said fence panel is mechanically weakened between said upper portion of said fence panel and the top ends of said supports.

11. The intrusion warning wire fence of claim 1, wherein said fence includes a series of adjacent fence panels extending between supporting poles, upper unsupported portions of adjacent fence panels being connected together only by means of of said energy conductor whereby any attempt by an individual to scale said fence creates a displacement of one upper portion of a fence panel relative to adjacent upper portions that causes a break or distortion of said energy conductor connecting said upper portions thereby resulting in a warning signal.

12. The intrusion warning wire fence of claim 11, wherein said energy conductor connecting said upper portions of adjacent fence panels passes alternately through openings provided in said adjacent upper portions and is also connected to the supporting pole between said adjacent fence panels.

13. The intrusion warning wire fence of claim 1, wherein said fence includes a series of adjacent fence panels extending between spaced supporting poles, energy conductors of each of these panels being connected together at said supporting poles.

14. The intrusion warning wire fence of claim 1, wherein said energy conductor is an optical fibre.

* * * * *